United States Patent [19]

Wolbrink

[11] 4,018,148

[45] Apr. 19, 1977

[54] LATCH FOR TRASH COMPACTORS

[75] Inventor: David W. Wolbrink, Hartford, Wis.

[73] Assignee: Broan Manufacturing Co., Inc., Hartford, Wis.

[22] Filed: Sept. 16, 1975

[21] Appl. No.: 613,923

[52] U.S. Cl. ..... 100/53; 100/229 A; 200/61.62; 292/123; 292/DIG. 69; 312/333

[51] Int. Cl.² ..... B30B 15/14

[58] Field of Search ..... 100/53, 229 R, 229 A; 200/61.62, 61.64; 292/DIG. 69, 123; 134/57 DL, 58 DL; 312/333, 319

[56] References Cited

UNITED STATES PATENTS

| | | | |
|---|---|---|---|
| 453,397 | 6/1891 | Hoffman | 312/333 X |
| 2,115,947 | 5/1938 | Ellison | 312/333 X |
| 2,278,268 | 3/1942 | Kempton | 134/57 DL |
| 2,641,122 | 6/1953 | Cavagnaro | 100/229 R |
| 3,537,390 | 11/1970 | Hinkel | 100/53 X |
| 3,772,984 | 11/1973 | Karls | 100/53 |
| 3,807,295 | 4/1974 | Engebretsen | 100/53 |
| 3,865,097 | 2/1975 | Robinson | 292/DIG. 69 |
| 3,874,282 | 4/1975 | Oouchi | 100/53 |

*Primary Examiner*—Billy J. Wilhite
*Attorney, Agent, or Firm*—Andrus, Sceales, Starke & Sawall

[57] ABSTRACT

A latch means for the access door of a household trash compactor incorporates a door position sensing switch directly in the latching mechanism thereby to insure that the compactor may be operated only when the door is fully closed and locked. The latch means includes a catch engageable with a bar to secure the door. The sensing switch is operable by the engagement of the catch with the bar to permit operation of the compactor.

7 Claims, 4 Drawing Figures

LATCH FOR TRASH COMPACTORS

BACKGROUND OF THE INVENTION

1. Field of the Invention

The present invention relates to trash compactors of the home appliance type and more particularly to an improved latch means for such compactors for retaining an access door in the closed condition.

2. Description of the Prior Art

Household trash compactors typically include a cabinet having a motor driven platen or ram mounted in the upper portion thereof which descends into a trash containing receptacle in the lower portion of the cabinet to effect compaction. The cabinet includes an access means by which trash to be compacted is deposited in the receptacle and the full receptacle removed to dispose of the compacted trash. The access means may comprise a door pivotally mounted on the cabinet along one of its edges which can be opened to insert trash and remove the receptacle. Or the access means may comprise a drawer containing the receptacle which is slidable into and out of the cabinet.

It will be readily appreciated that from the safety standpoint it is important to block access to the receptacle during the compaction process. A latch is thus provided on the compactor which retains the access means in the closed position. A sensing means is also provided for the purpose of sensing the position of the access means and allowing the compaction mechanism to operate only when the access means is in the closed position. For this purpose a limit switch is positioned in the cabinet for operation by the movement of the door. The switch is inserted in the electrical circuitry for controlling the operation of the latter.

Unfortunately, with heretofore available compactors under certain conditions the compactor may be operated even though the door is not fully closed. For example, the access means of the compactor may become bent from distortion of the door or receptacle during or as a result of compaction so as to operate the sensing means while the access means is in the open position. Or tipping of the receptacle due to unbalanced loading of the receptacle may cause a similar circumstance. Or the position of the sensing means with respect to the access means may become altered also permitting operation of the compactor.

The foregoing constitutes a serious safety hazard in that it allows fingers to become pinched in the slightly open door and allows shattered glass and noxious fumes to escape from the compactor during compaction.

It also may give rise to a situation in which the compactor will not operate even though the user has closed the access means in the proper manner. Or movement of the receptacle or drawer during compaction may open the switch shutting down the compactor. Because this occurs with the ram in the receptacle, the receptacle and access means tend to be immobilized, preventing reclosing of the switch. The compactor is thus stuck with the ram in the lowered position. This necessitates a service call to retract the ram so that the compactor can be opened. In some designs, multiple sensing means are employed to insure proper operation and avoid this condition.

SUMMARY OF THE PRESENT INVENTION

In contrast to the foregoing, the present invention provides a latch means for the access means which prevents operation of the compactor except when the access means is fully closed and the latch means is in a locked condition which precludes opening of the access means. The gist of the present invention is to use the condition of the latch means, not the condition of the door, to operate the sensing means. For this purpose, the latching mechanism and safety switch are combined into a single structure so that the latter cannot be actuated except by the actual locking of the latch mechanism which prevents opening of the access means. The heretofore existing condition in which the access means may not be fully closed yet the compactor can be operated or in which the operation of the compactor is interrupted with the ram in the lowered position cannot therefore occur.

The present invention provides reliable operation to the compactor and locates the sensory means in a relatively inaccessible location. This further improves the safety aspects of the compactor.

DESCRIPTION OF THE PREFERRED EMBODIMENT

Figure 1:
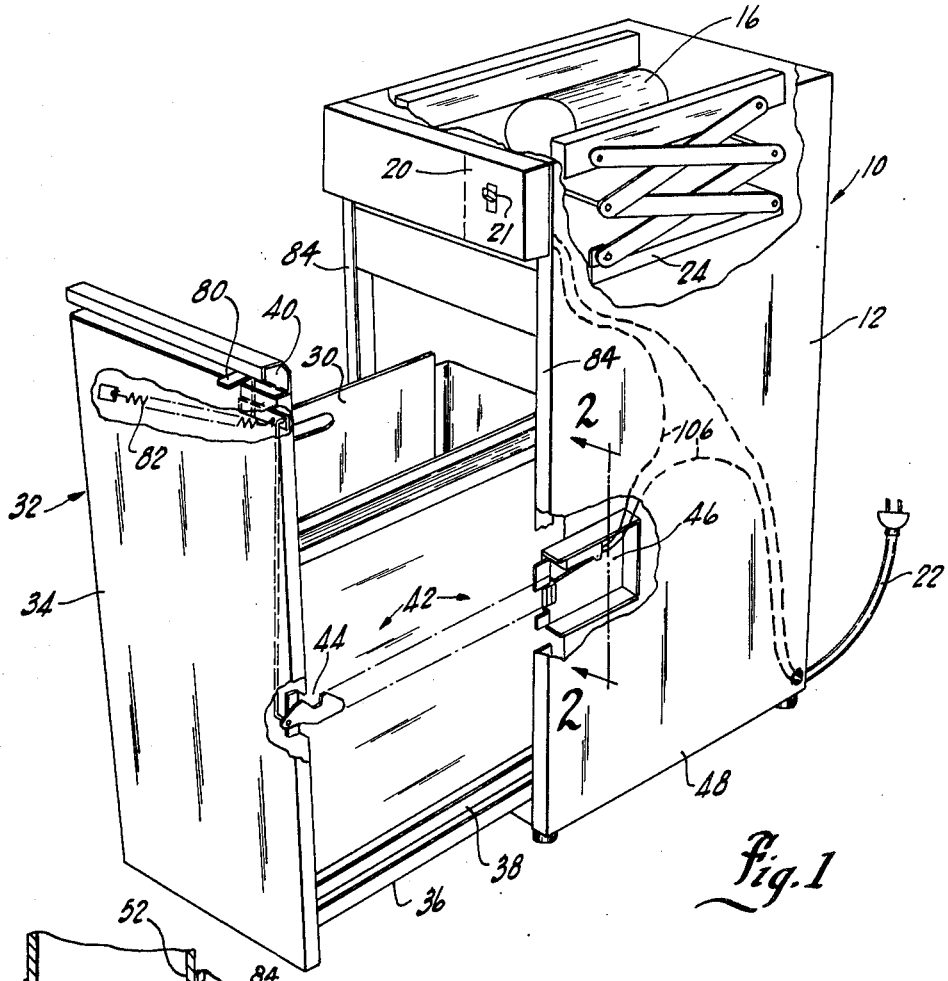
FIG. 1 is a perspective view of a trash compactor. Portions of the view have been broken away to show the improved latch structure of the present invention.

Turning now to the Figures, there is shown in FIG. 1 a trash compactor identified by the numeral 10. Trash compactor 10 typically includes cabinet 12 containing compacting mechanism 14 in the upper portions thereof. Compacting mechanism 14 is powered by motor 16 which is energized through control 20 from power cord 22. Motor 16 is coupled to compacting platen or ram 24 through a lead screw and nut mechanism not shown which provides both linear movement and mechanical advantage to platen 24. The coupling may be direct or through an extensible linkage system.

Receptacle 30 for receiving the trash to be compacted is positioned in the lower portion of cabinet 12. An access means is provided to the interior of cabinet 12 through which the trash may be deposited in receptacle 30 and the receptacle removed from cabinet 12 to dispose of the compressed trash. In the embodiment shown in the Figures, drawer 32 is provided for this purpose having a drawer front panel 34 formed of a portion of one of the vertical walls of the cabinet. A support deck 36 on which receptacle 30 rests is attached to the lower portion of the drawer front panel. Drawer 32 is movable into and out of cabinet 12 on horizontal rails 38 by means of hand grasp 40.

In the event the trash compactor is designed as a built-in unit, as for example, under the kitchen counter, cabinet 12 may be omitted. The compactor is provided with a framework which positions the elements in the compactor and which includes an exposed front wall containing the access means.

Latch means 42 is provided to hold drawer 32 in the closed position so as to seal cabinet 12 and prevent access to the interior, particularly, during periods when compaction is taking place. Latch means 42 is comprised of catch means 44, shows as mounted on panel 34 in the Figures, and engagement means 46 shown as mounted on the inside of one of the vertical walls 48 of cabinet 12.

Figure 2:
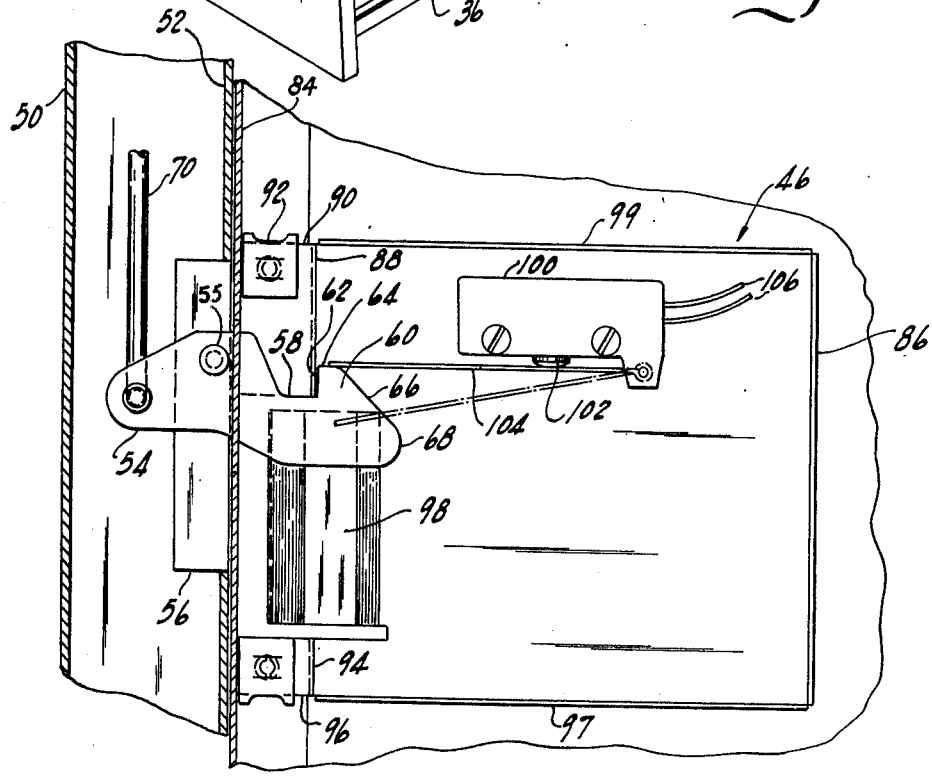
FIG. 2 is a partial cross sectional side view of the improved latch mechanism of the present invention taken in the direction of the line 2—2 of FIG. 1.

Drawer front panel 34 is typically hollow having exterior sheet 50 and rear sheet 52 which faces the interior of cabinet 12 when drawer 32 is closed, as shown in FIG. 2. Catch means 44 includes catch 54 pivotally mounted on drawer 32. For example, an opening may be provided in rear sheet 52 adjacent one of the vertical edges of front panel 34 as by puncturing sheet 52 and bending tab 56 into the front panel. Catch 44 may be mounted on this tap by pivot 55 or a separate bracket may be provided on panel 34.

The end of catch 54 extending away from front panel 34 includes notch 58 formed by projection 60. Projection 60 contains vertical edge 62, upper horizontal surface 64 and forward ramping surface 66 which terminates in curved end 68. Notch 58 and vertical edge 62 lie generally below a horizontal plane containing the axis of pivot 55, as shown in FIG. 2. The portion of catch 54 extending inwardly of drawer panel 34 engages rod 70. Upward movement of rod 70 causes the outer portion of catch 54 including notch 58 to move downward about pivot 55.

Figure 3:
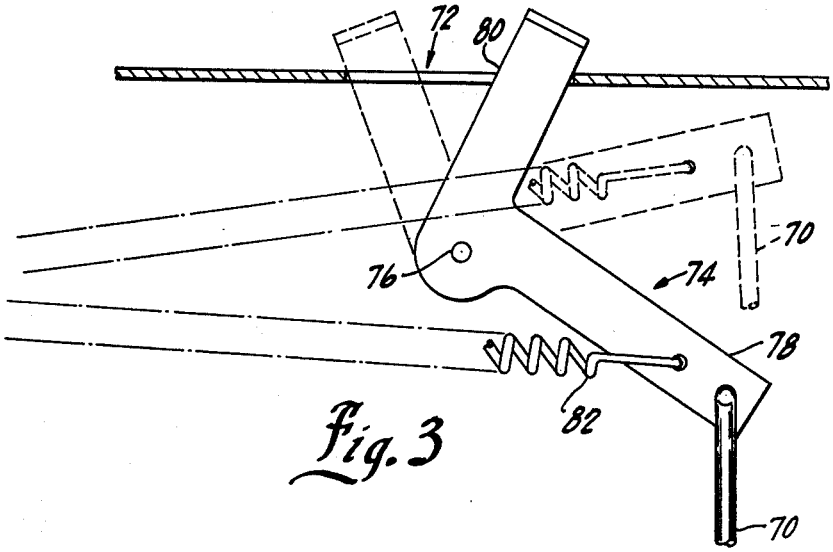
FIG. 3 is a partial cross sectional view showing the operating means for the catch portion of the improved latch mechanism of the present invention.

Rod 70 is operable by lever mechanism 72 mounted in the upper portion of drawer front panel 34, as shown generally in FIG. 1 and more particularly in FIG. 3. Lever mechanism 72 includes L-shaped lever 74 rotatably mounted in the interior of drawer front panel 34 by pivot 76. The end of one arm 78 of lever mechanism 72 is connected to rod 70. The end of the other arm 80 extends above drawer front panel 34 so as to be operable by the user of trash compactor 10. Tensile means, such as coil spring 82, has one end anchored in drawer front panel 34 and the other end coupled to arm 78 for providing a bias force to lever mechanism 72.

Cabinet 12 includes flanges 84 which abut with drawer 32 when the drawer in in the closed position. Engagement means 46 for catch means 44 is affixed to the interior of wall 48 partially behind one of flanges 84.

Figure 4:
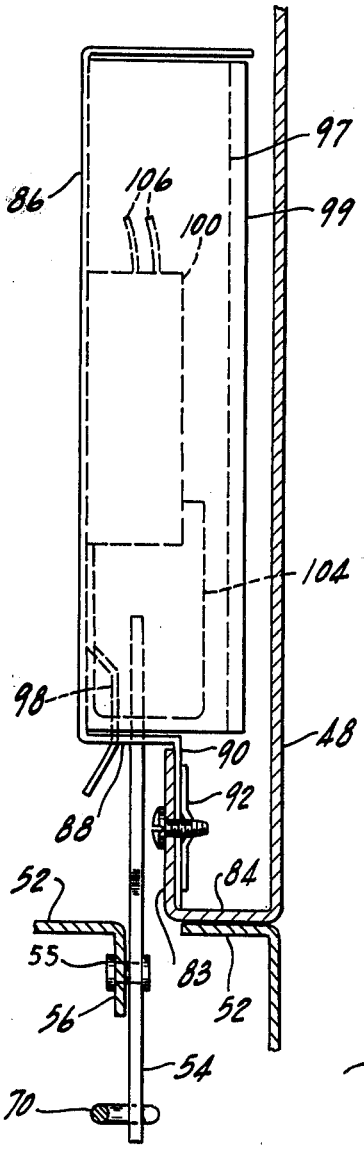
FIG. 4 is a top view of the engagement portion of the latch means of the present invention.

As shown in FIGS. 1, 2, and 4, engagement means 46 includes a box-like frame 86. The forward portions of frame 86 includes an upper front wall 88 having a width less than the top, bottom, and rear walls of the frame. Upper front wall 88 terminates in bracket 90 containing fastener means 92 for frame 86. Lower front wall 94 is similarly formed to include bracket 96 for fastener means 92. Between upper and lower front walls 88 and 94 is provided deflector 98 for catch 54 which guides the catch into engagement means 86. Frame 86 is affixed to lip 83 of flange 84 by fastener means 92 so that frame 86 is contiguous with the interior of the wall. Lower wall 97 of the frame may be spaced from the interior of wall 48 by an amount greater than upper wall 99 to permit any glass fragments to fall from the frame thereby to insure trouble free operation of the latch means.

Deflector 98 lies inwardly of the edge of flange 84 so that catch 54 enters engagement means 46 between the deflector and the flange, as shown in FIG. 4.

Included in frame 86 is limit switch 100 having movable sensory element 102, operable by arm 104 pivotally mounted at one of its ends on the switch so as to control the circuit condition of the switch. The other end of arm 104 is adapted to contact projection 60 of catch 54 for operating switch 100.

As shown in FIG. 1, switch 100 is connected in conductor 106 extending from power chord 22 to control 20 so as to prevent energization of motor 16 and compacting mechanism 14 except when switch 100 is closed.

In the operation of trash compactor 10, drawer 32 is opened and the trash to be compacted placed in receptacle 30. The drawer is then slid inwardly. As the inner sheet 52 of drawer front panel 34 approaches abutment with flange 84 of cabinet 12, catch 54 moves past the inner edge of flange 84 and between the flange and deflector 98. In this manner, catch 54 is inserted in engagement means 46. Catch 54 contacts upper front wall 88 along forward ramp surface 66, causing catch 54 to be rotated in a clockwise direction about pivot 55, when viewed as in FIG. 2. The curved forward end 68 of catch 54 also contacts switch arm 104 to commence the actuation of switch 100. The clockwise movement of catch 54 causes an upward movement of rod 70 and a counter clockwise movement of lever mechanism 72 against the bias of spring 82.

As the insertion of catch 54 into engagement means 46 nears completion, the upper surface 64 of projection 60 moves under upper front wall 88 so that when inner sheet 52 contacts flanges 84, projection 60 is beyond upper front wall 88 and catch 54 rotates in the counter clockwise direction to bring projection 60 behind upper front wall 88 and insert the upper front wall 88 into notch 58 and into contact with vertical edge 62. At the same time, the upper surface 64 of projection 60 operates arm 104 to close limit switch 100 and permit operation of control circuitry 20.

From the foregoing, it will be appreciated that in the present invention, the same action which latches drawer 32 shut by inserting upper front wall 88 of engagement means 46 in notch 58 of catch 54 also actuates limit switch 100 and permits operation of control circuit 22. The circuitry can thus only be operated when drawer 32 is both shut and latched and there exists no possibility that the access means may not be shut and yet the compactor is operable.

With limit switch 100 actuated, switch 21 may be operated to cause motor 16 to drive ram 24 into receptacle 30 to compact the trash and thereafter retract the ram. Any forces generated during compaction in a direction to open drawer 32 tend to rotate catch means 44 counter clockwise through the moment developed by the forces applied through the axis of pivot 55 and along vertical edge 62. This serves to more securely retain catch means 44 in engagement means 46 under these conditions to prevent opening of the drawer.

To unlatch drawer 32, lever 80 is rotated in the counter clockwise direction, when viewed as in FIG. 3, to raise rod 70 and lower the end of catch 54 in engagement means 46 so that projection 60 clears the lower edge of upper front wall 88, allowing drawer 32 to be slid open.

By rotating lever 80 all the way to the left, spring 82 assumes an over center condition with respect to pivot 76, retaining lever 74 in that condition and catch 54 in a condition in which it will not engage upper front wall 88 when drawer 32 is closed. This facilitates the opening and closing of drawer 30 when compaction is not required as for the repeated insertion of food scraps during preparation of a meal. However, compacting mechanism 16 cannot be operated until drawer 32 is completely shut and lever 80 moved to the right to engage projection 60 with front wall portion 88 so as to actuate limit switch 100.

Various modes of carrying out the invention are contemplated as being within the scope of the following claims particularly pointing out and distinctly claiming the subject matter which is regarded as the invention.

I claim:

1. In a trash compactor having means positioning a compaction means energized from a power source for movement along a compaction axis into and out of a trash containing receptacle, said compactor having panel means movable with respect to the positioning means between an access position and a blocking position, an improved latch means for the panel means comprising: catch means mounted on one of said positioning means and panel means insertable in an engagement means mounted on the other of said positioning means and panel means, one of said catch means and engagement means being mounted at a pivot point for pivotal movement about an axis perpendicular to the direction of insertion of said catch means into said engagement means, said catch means having a portion extending along the direction of insertion and containing a notch having a surface normal to the direction of insertion; said engagement means having a bar engagable with said extension portion and insertable in said notch in abutment with the normal surface by the pivotal movement of one of said catch means or engagement means upon insertion of said catch means in said engagement means for restraining said catch means from removal from said engagement means for locking said panel means in the blocking position, the location of the abutting surface and bar being displaced from said pivot point in a direction normal to the direction of insertion such that forces tending to move the panel means to the access position tend to pivot the movable element into the engaged condition, said engagement means including switch means interposed between said compaction means and said power source and operable by the movement of said catch means to the restrained state for rendering said compaction means operable.

2. The improved latch means of claim 1 including means for disengaging said notch from said bar for permitting movement of said panel means to the access position.

3. The improved latch means of claim 1 wherein said catch is in the panel means and said engagement means is in said positioning means.

4. The improved latch means according to claim 4 wherein said catch means is mounted at a pivot point for pivotal movement about an axis perpendicular to the direction of insertion, said surface of said notch being displaced from said pivot point in a direction normal to the direction of insertion such that forces tending to move the panel means to the access position tend to pivot said catch means into the engaged condition.

5. The improved latch means of claim 4 including means for disengaging said notch from said bar for permitting movement of said panel means to the access position and wherein said disengaging means is further defined as means for pivotally moving said catch out of engagement with said bar.

6. The improved latch means of claim 5 including means for retaining said catch in the pivoted condition of disengagement.

7. The improved latch means according to claim 4 wherein said catch means includes bias force means for urging said catch means into the restrained position.

* * * * *